United States Patent [19]

Nishioka

[11] 4,306,418

[45] Dec. 22, 1981

[54] CONDENSING TURBINE INSTALLATION

[75] Inventor: Ryozo Nishioka, Kawasaki, Japan

[73] Assignee: Fuji Electric Co., Ltd., Kawasaki, Japan

[21] Appl. No.: 100,062

[22] Filed: Dec. 4, 1979

[30] Foreign Application Priority Data

Dec. 5, 1978 [JP] Japan ..... 53-150846
Dec. 5, 1978 [JP] Japan ..... 53-150847

[51] Int. Cl.[3] ..... F01K 9/00
[52] U.S. Cl. ..... 60/693
[58] Field of Search ..... 60/670, 693

[56] References Cited

FOREIGN PATENT DOCUMENTS 514551 10/1952 Belgium ..... 60/693
551671 10/1956 Belgium ..... 60/693
2737539 3/1979 Fed. Rep. of Germany ..... 60/693

*Primary Examiner*—Allen M. Ostrager
*Attorney, Agent, or Firm*—Sughrue, Mion, Zinn, Macpeak and Seas

[57] ABSTRACT

A double flow-type steam turbine installation in which two turbine sections of a double flow-type steam turbine are provided with different final stage steam path areas. The turbine section with the higher area is connected to a high vacuum condenser while the turbine section with the lower area is connected to a low vacuum condenser. The cooling water systems of the two condensers are connected in series with each other. The efficiency of the system is significantly increased over previous installations.

6 Claims, 9 Drawing Figures

CONDENSING TURBINE INSTALLATION

BACKGROUND OF THE INVENTION

This invention relates to a double flow-type condensing turbine installation and specifically is intended to improve the plant thermal consumption factor.

A conventional double flow-type condensing turbine installation, as shown in FIG. 1, includes a double flow-type steam turbine 1, a steam pipe 53 adapted to introduce steam from the central portion of the steam turbine 1 into the right and left turbine sections 3 and 2, a single pressure-type condenser 4 for condensing exhaust steam from the turbine sections 2 and 3, a cooling water pipe 5 of the condenser 4, a condensation pump 6 for returning condensation from the condenser 4 to a boiler (not shown), and a generator 7 coupled to the steam turbine 1. In this case, the right and left turbine sections 3 and 2 are symmetrical in configuration and accordingly they have the same steam path area in the turbine final stage and vane length. The exhaust outlets of these turbine sections 2 and 3 are combined into a single unit at the condenser 4.

In the double flow-type condensing turbine installation thus constructed, steam, for instance, from a high pressure turbine, is introduced through the steam pipe 53 into the right and left turbine sections 3 and 2. The steam, after expanding to perform work in the turbine sections 2 and 3, is supplied to the condenser 4 where it condenses into water which is returned into the boiler by means of the condensation pump 6. In this case, it is desirable that the degree of vacuum of the condenser be set as high as possible in order to recover, as much as possible, the energy of the steam as useful power.

Shown in FIG. 2 is a conventional multi-flow exhaust-type, here a four-flow exhaust-type, condensing turbine installation employed in a large scale heat power plant or a nuclear power plant.

In the condensing turbine installation, steam from a boiler (not shown) is supplied through a main steam pipe 101 into a high pressure turbine 102, steam exhausted by the high pressure turbine 102 is introduced into a reheater 103, the reheated steam of which is supplied to a middle pressure turbine 104. Exhaust steam from the middle pressure turbine 104 is introduced into a plurality of low pressure turbines 105 and 106 which are of like configuration. As each of the low pressure turbines 105 and 106 is a double flow-type steam turbine, the condensing turbine installation described above is a four-flow type steam turbine. Steam flows discharged by the steam turbines 105 and 106 are delivered in a parallel mode to a single pressure-type condenser 107 where they are condensed into water which is then returned to the boiler by a condensation pump 108. The degree of vacuum of the condenser 107 is set as high as possible so as to recover as much as possible of the energy of steam as power. In FIG. 2, reference numeral 109 designates a cooling water pipe and reference numeral 110 designates a generator.

In the conventional condensing turbine installation described above, the degree of vacuum of the condenser is determined from the rise of temperature of the cooling water in the condenser and the minimum final temperature difference (the saturated steam temperature in the condenser minus the temperature of cooling water at the outlet) which is actually achieved. The limit of the final temperature difference is 2.8° C. as usual in Japan and the United States. It is difficult to provide a final temperature difference more than that. Accordingly, heretofore, the vacuum pressures of the single pressure-type condensers 4 and 107 of the above-described double flow-type condensing turbine installations had to be determined under the conditions mentioned above. Thus, with the above-described single pressure-type condenser, it is difficult to recover much of the energy of the steam with the results that the plant thermal consumption factor is low and the fuel expense is increased. This is one of the difficulties accompanying a conventional condensing turbine installation.

In order to eliminate this difficulty, a method has been proposed in the art, in which, as shown in FIG. 3, a double pressure-type condenser 117 is coupled to multi-flow exhaust-type steam turbines 105 and 106 which are similar in construction to those shown in FIG. 2. In this case, in comparison with the single pressure-type condenser 107 in FIG. 7, the total cooling area ($Fc_1+Fc_2$) of the condenser 117 is set equal to the cooling area Fc of the single pressure-type condenser 107. Therefore, steam discharged by the steam turbine 105 is delivered to a high vacuum side condensing chamber 117I while steam from the steam turbine 106 is supplied to a low vacuum side condensing chamber 117II while the cooling water flows in series through the condensing chambers 117I and 117II through a pipe 119. However, as the logarithmic temperature differences of the condensing chambers 117I and 117II are small in this case, the final temperature differences $\Delta T1$ and $\Delta T2$ of the condensing chambers 117I and 117II are larger than the final temperature difference $\Delta T$ of the single pressure condenser. Therefore, the degree of vacuum of the condenser 117I is improved. However, the degree of vacuum of the condenser 117II is made worse than that in the case of the single pressure type condenser. Thus, the overall improvement in the thermal efficiency of the installation is low as a whole.

In FIG. 4, reference characters ti, tm and to designate the inlet temperature, the middle temperature and the outlet temperature of the cooling water, respectively while ts and Fc designate respectively the saturated steam temperature and the cooling area of the single pressure-type condenser 107 and $ts_1$ and $Fc_1$ and $ts_2$ and $Fc_2$ the saturated steam temperatures and the cooling area of the condensing chambers 117I and 117II of the double pressure-type condenser 117, respectively. In FIG. 4, the curve A (dashed line) and the curve B (solid line) indicate the increasing variations of the cooling water in the single pressure-type condenser 107 and the double pressure-type condenser 117, respectively.

SUMMARY OF THE INVENTION

In view of the foregoing, an object of the present invention is to improve the plant thermal consumption factor in a double flow-type condensing turbing installation thereby reducing the cost of operation and decreasing the consumption of energy of the installation.

The foregoing object and other objects of the invention have been achieved by the provision of a double flow-type condensing turbine installation in which, according to the invention, two turbine sections of a double flow-type steam turbine have different final stage steam path areas, the one of the two turbine sections which is larger in final stage steam path area being coupled to a high vacuum condenser, the other being coupled to a low vacuum condenser, and the cooling water systems of the high vacuum condenser and low vacuum condenser being connected in series with each other.

The nature, principle and utility of the invention will become more apparent from the following detailed description and the appended claims when read in conjunction with the accompanying drawings.

DETAILED DESCRIPTION OF THE PREFERRED EMBODIMENTS

Figure 1:
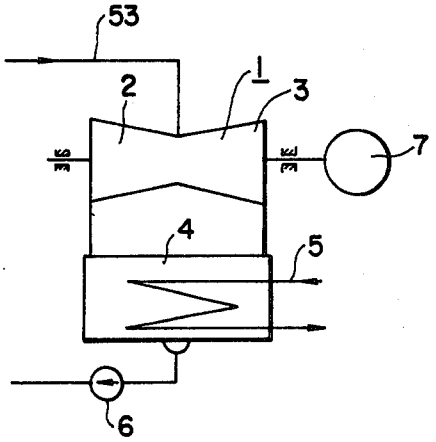
FIG. 1 PRIOR ART
FIG. 1 is an explanatory diagram showing the arrangement of a conventional double flow-type condensing turbine installation.
Figure 5:
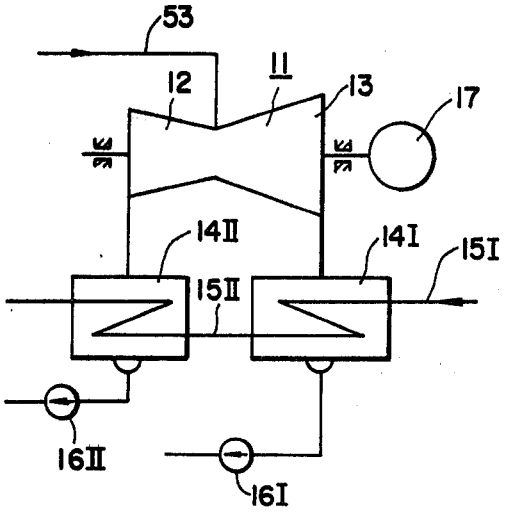
FIG. 5 is an explanatory diagram showing the arrangement of a double flow-type condensing turbine installation according to the present invention.

Referring to FIG. 5, the right and left turbine sections 13 and 12 of a double flow-type steam turbine 11, in accordance with the invention, are provided with different final stage steam path areas and, accordingly, final stage vane lengths. In the embodiment of FIG. 5, the final stage steam path area of the right turbine section 13 is larger than that of the left turbine section 12. The turbine section 13, which is larger in final stage steam path area, is connected to a high vacuum condenser 14I while the turbine section 12 is connected to a low vacuum condenser 14II of which the vacuum pressure being substantially equal to that of the conventional condenser shown in FIG. 1. The cooling water pipes 15I and 15II of the condensers 14I and 14II are connected in series with each other. Cooling water is first supplied to the condenser 14I and the cooling water discharged by the condenser 14I is supplied to the condenser 14II. The sum of the cooling areas of the two condensers 14I and 14II is selected so as to be larger than the cooling area of the conventional single pressure-type condenser 4 so that the final temperature differences of the condensers 14I and 14II are the minimum values actually achievable. In the case where steam flows discharged from the right and left turbine sections 13 and 12 are introduced into the two condensers of different vacuum pressures, the discharge steam volumetric flow rate of the right turbine section 13 connected to the high vacuum condenser 14I is necessarily larger than that of the left turbine section 12 connected to the low pressure condenser 14II. Accordingly, if the final stage steam path area of the turbine section 13 is made equal to that of the other turbine section 12, then the exhaust loss of the turbine section 13 is increased. For this reason, the final stage steam path area of the turbine section 13 is selected to be larger than that of the turbine section 12 so that its exhaust loss is minimized.

Figure 6:
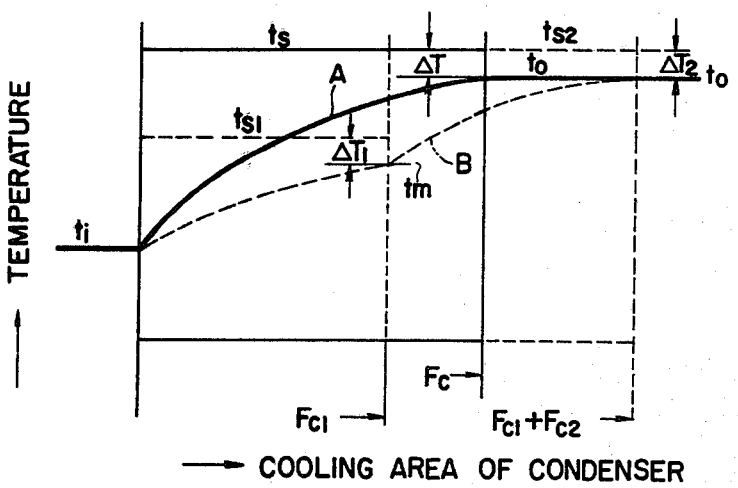
FIG. 6 is a graphical representation indicating the variations in temperature of condenser cooling water with the invention.

The operation and effect of the double flow-type condensing turbine installation thus constructed according to the invention will be described with reference to FIG. 6 which is a graphical representation indicating variations in temperature of condenser cooling water. In FIG. 6, reference characters ts, $ts_1$ and $ts_2$ designate the saturated steam temperatures of the condensers 4, 14I and 14II, respectively. $\Delta T$, $\Delta T_1$ and $\Delta T_2$ designate the final temperature differences of the condensers 4, 14I and 14II ($\Delta T \cong \Delta T_1 \cong \Delta T_2$), respectively, Fc, $Fc_1$ and $Fc_2$, the cooling areas of the condensers 4, 14I and 14II ($Fc < Fc_1 + Fc_2$), respectively, and ti, tm and to, the inlet temperature, the middle temperature and the outlet temperature of the cooling water, respectively. In FIG. 6, the curve A (solid line) indicates the variations in the temperature of the cooling water in the conventional condenser 4 shown in FIG. 1 and the curve B (broken line) indicates the variations in temperature of condenser cooling water in the turbine installation according to the invention.

Steam introduced through the steam pipe 13 is allowed to flow at substantially equal flow rates into the right and left turbine sections 13 and 12. The steam flows expand in the turbine sections 12 and 13 to perform work thereby driving a generator 17. In this operation, steam from which energy is effectively recovered by the expansion in the turbine section 13 due to the high vacuum, is delivered to the high vacuum condenser 14I through the final stage steam path which has the larger area and small exhaust loss where it is condensed into water which is returned to the boiler by means of a condensation pump 16I. On the other hand, steam discharged by the turbine section 12 is delivered to the low vacuum condenser 14II where it is condensed into water which is returned to the boiler by a condensation pump 16II.

In this case, the temperature ti of cooling water which is supplied to the high vacuum condenser is increased to the temperature tm in the condenser 14I and, accordingly, the temperature difference $\Delta T_1$ between the saturated steam temperature $ts_1$ of the condenser 14I and the cooling water middle temperature tm becomes the minimum final temperature difference 2.8° C. which can be obtained in practice. Thereafter, the cooling water at the middle temperature tm is delivered to the low vacuum condenser 14II where it is heated to the outlet temperature to and is then discharged. In this case also, the temperature difference $\Delta T_2$ between the saturated steam temperature $ts_2$ of the condenser 14II and the cooling water outlet temperature to becomes the minimum final temperature difference 2.8° C. which can be obtained in practice.

As is clear from the above description, the steam introduced into the turbine section 13 is expanded to a high degree of vacuum corresponding to the saturated steam temperature $ts_1$ of the high vacuum condenser 14I and is effectively converted into power. Furthermore, in this case, as the final stage steam path area of the turbine section 13 is set large, effective heat drop due to the high vacuum of the condenser 14I can be utilized without increasing the exhaust loss. Accordingly, with the double flow-type condensing turbine installation of the invention, the plant thermal consumption factor is greatly improved in comparison with that of a conventional installation. This is apparent from the follwing Table 1 in which the data from the double flow-type condensing turbine installation to which the technical concept of the invention is applied are compared with data from a conventional installation. As may be seen from the Table, the thermal consumption factor can be improved by as much as 11 Kcal/KWh.

TABLE 1

| | Conventional installation | Present installation | |
|---|---|---|---|
| Output (MW) | 175 | 175 | |
| Initial steam pressure (atg) | 250 | 250 | |
| Initial steam temperature (°C.) | 538 | 538 | |
| Preheat temperature (°C.) | 538 | 538 | |
| Cooling water temperature (°C.) | 21.7 | 21.7 | |
| Cooling water quantity (t/h) | 17400 | 17400 | |
| Cooling area ($m^2$) | 9572 | 6413 | 6152 |
| Final temperature difference (°C.) | 2.8 | 2.8 | 2.8 |
| Internal pressure in condenser (ata) | 0.052 | 0.0406 | 0.052 |
| Final stage steam path area ($m^2$) | 5 × 2 | 6.3 | 5 |
| Thermal consumption factor (Kcal/KWh) | 1845 | 1834 | |

Figure 2:
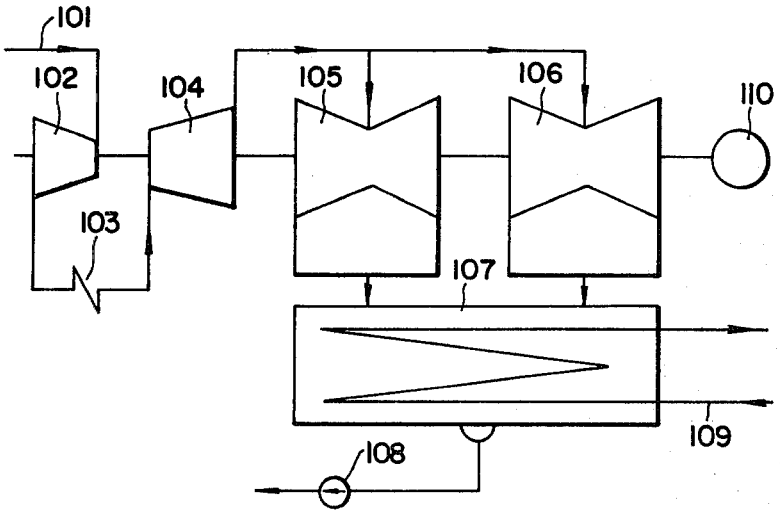
FIG. 2 PRIOR ART
FIG. 2 is an explanatory diagram showing the arrangement of a conventional condensing turbine installation with a four-flow exhaust-type low pressure turbine coupled to a single pressure type condenser.
Figure 3:
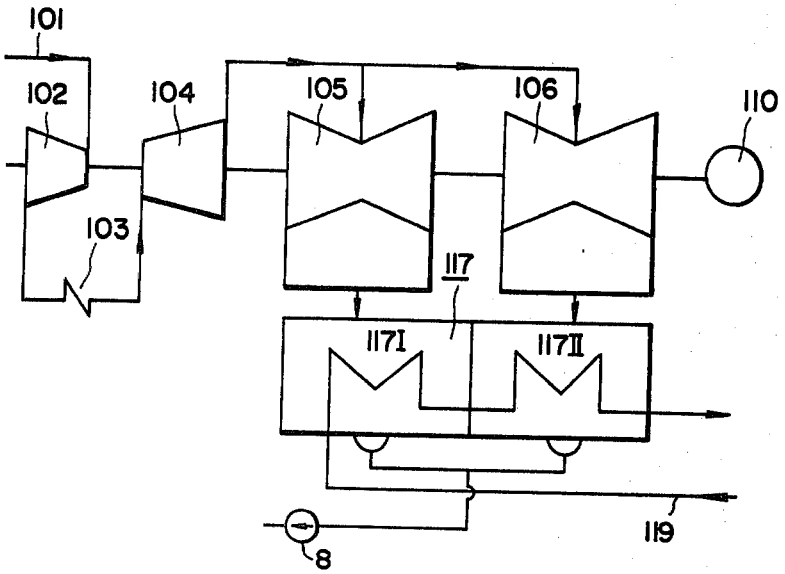
FIG. 3 PRIOR ART
FIG. 3 is also an explanatory diagram showing the arrangement of a conventional condensing turbine installation with a four-flow exhaust-type low pressure turbine coupled to a double pressure-type condenser.
Figure 4:
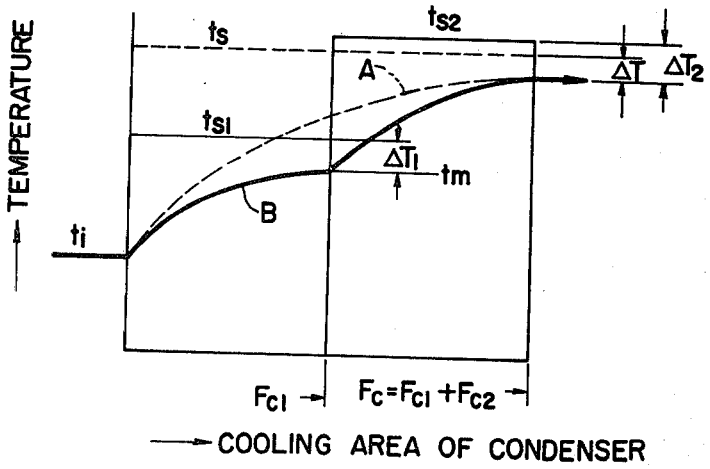
FIG. 4 PRIOR ART
FIG. 4 is a graphical representation indicating the variations in temperature of condenser cooling water in the turbine installations shown in FIGS. 2 and 3.

A second example of a condensing turbine installation according to the invention will be described with reference to FIG. 7 in which those components which have been previously described with reference to FIG. 2 are therefore similarly numbered or designated.

Figure 7:
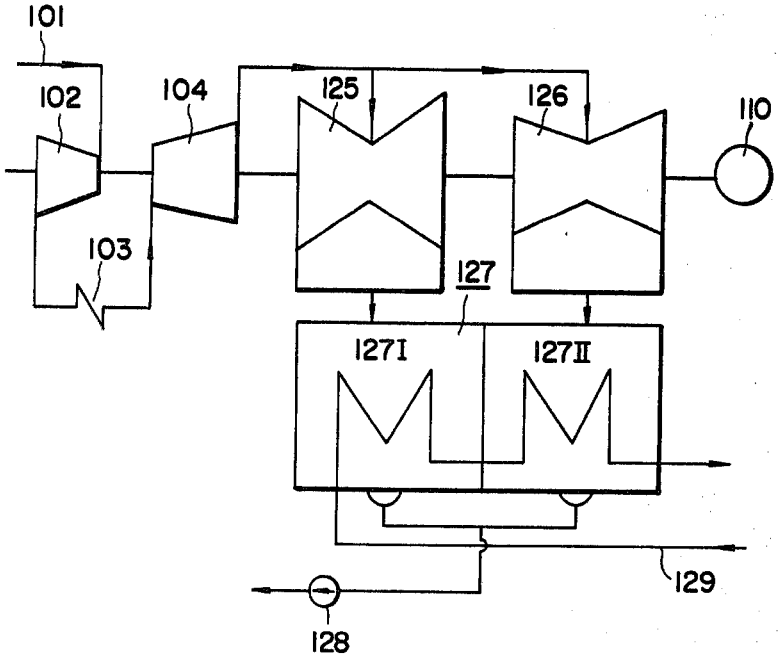
FIG. 7 is an explanatory diagram showing the arrangement of a multi-flow exhaust-type condensing turbine installation according to the invention.

A low pressure turbine of a large capacity steam turbine as shown in FIG. 7 is arranged according to this embodiment of the invention as follows. The two double-flow-type steam turbines 125 and 126 forming a low pressure turbine have different final stage steam path areas and final stage vane lengths. In this second embodiment, the final stage steam path area of the left steam turbine 125 is larger than that of the right steam turbine 126. Furthermore, the steam turbine 125 having the larger final stage steam path area is coupled to the high vacuum condensing chamber 127I of a double pressure-type condenser 127 while the steam turbine 126 is coupled to the low vacuum condensing chamber 127II of the condenser 127 with the vacuum pressure being substantially equal to that of the single pressure-type condenser shown in FIG. 2. A cooling water pipe 129 is arranged through the two condensing chambers 127I and 127II so that cooling water is first supplied to the high vacuum condensing chamber 127I and is then discharged by the condensing chamber 127I and supplied to the low vacuum condensing chamber 127II. In this case, the total cooling area of the condensing chambers 127I and 127II is set to be larger than the cooling area of the conventional single pressure-type condenser 107 and the total cooling area of the conventional double pressure-type condenser 117 so that the final temperature differences of the condensing chambers 127I and 127II are substantially equal to the minimum values that can in practice be achieved. In the second example, the condensing chambers 127I and 127II are separately formed as a unitary double pressure-type condenser 127. However, they may alternatively be provided as independent condensers if desired.

Figure 8:
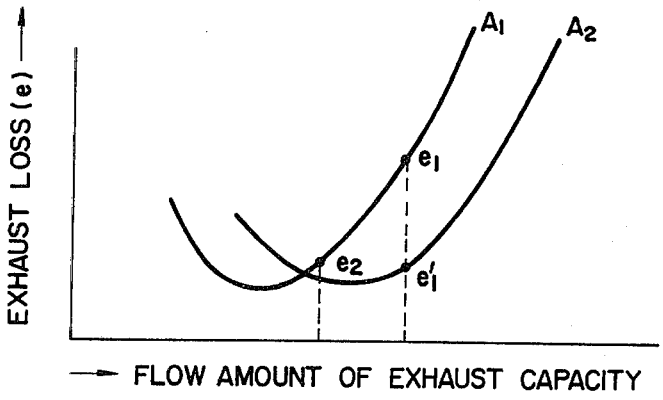
FIG. 8 is a graphical representation indicating the relations between final stage steam path area and exhaust loss in the steam turbines with the invention.

When the steam turbines 125 and 126 are coupled to the condensing chambers 127I and 127II of different vacuum pressures, the exhaust steam volumetric flow rate of the left steam turbine 125 coupled to the high vacuum condensing chamber 127I is essentially larger than that of the right steam turbine 126 coupled to the low vacuum condensing chamber 127II. In this connection, the exhaust loss curves of the steam turbines, as indicated in FIG. 8, depend on the final stage steam path areas $A_1$ and $A_2$ ($A_1 < A_2$). Therefore, if the final stage steam path area of the steam turbine 125 is made equal to that ($A_1$) of the steam turbine 126, then the exhaust loss $e_1$ of the steam turbine 125 increases. Especially based on this fact, according to the invention, the final stage steam path area $A_2$ of the steam turbine 125 coupled to the high vacuum condensing chamber 127I is selected to be larger than that $A_1$ of the steam turbine 126 so that the exhaust loss decreases with the increasing exhaust steam volumetric flow rate.

Figure 9:
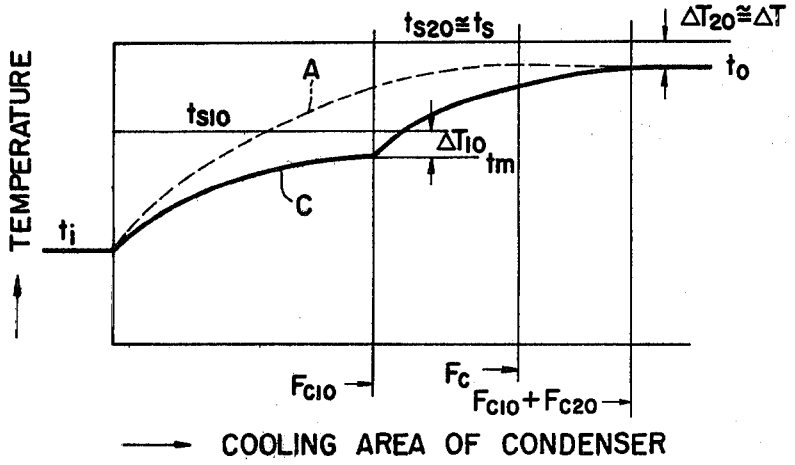
FIG. 9 is also a graphical representation indicating the variations in temperature of condenser cooling water in the multi-flow exhaust-type turbine installation shown in FIG. 7.

The operation and effect of the four-flow exhaust type condensing turbine installation as constructed above according to the invention will be described with reference to FIG. 9 which also indicates the temperature variation curve of condenser cooling water. In FIG. 9, reference characters $ts_{10}$ and $ts_{20}$ designate the saturated steam temperatures of the condensing chambers 127I and 127II, respectively, $\Delta T_{10}$ and $\Delta T_{20}$, the final temperature differences of the condensing chambers 127I and 127II, respectively ($\Delta T_{10} \cong \Delta T_{20} \cong \Delta T$), and $Fc_{10}$ and $Fc_{20}$, the cooling areas of the condensing chambers 127I and 127II, respectively ($Fc_{10} + Fc_{20} > Fc = (Fc_1 + Fc_2)$). In FIG. 9, the curve C (solid line) indicates the temperature variations of cooling water in the turbine installation according to the invention.

Steam introduced through the high pressure turbine 102 and the middle pressure turbine 104 into the low pressure turbine which is the four-flow exhaust-type steam turbine is supplied in equal flow rates into the right and left double flow-type steam turbines 126 and 125. The steam flows thus supplied expand in the respective steam turbines 125 and 126 to perform work and thereby drive the generator 110. In this operation, the steam which expands to a high vacuum in the steam turbine 125 thereby permitting the energy to be effectively recovered, is delivered to the high vacuum condensing chamber 127I through the final stage having the steam path larger in area and with the exhaust loss being small. It is there condensed into water in the condensing chamber 127I. On the other hand, the steam discharged from the steam turbine 126 is delivered to the low vacuum condensing chamber 127II where it is condensed. The condensations are returned to the boiler by the condensation pump 128.

In this case, the temperature ti of the cooling water which is first supplied to the high vacuum condensing chamber 127I is increased to the middle temperature tm in the condensing chamber 127I. The temperature difference $\Delta T_{10}$ between the saturated steam temperature $ts_{10}$ of the condensing chamber 127I and the cooling water middle temperature tm becomes the minimum final temperature difference 2.8° C. which can be actually achieved. Thereafter, the cooling water at the middle temperature tm is delivered to the low vacuum condensing chamber 127II where the temperature is raised to the outlet temperature to. In this case also, the temperature difference $\Delta T_{20}$ between the saturated steam temperature $ts_{20}$ of the condensing chamber 127II and the cooling water outlet temperature to becomes the minimum final temperature difference 2.8° C. attainable. As is clear from the above description, the steam introduced into the steam turbine 125 is expanded with a high vacuum corresponding to the saturated steam temperature $ts_{10}$ of the high vacuum condensing chamber 127II thus being effectively converted into power. In this case, since the area $A_2$ of the final stage steam path of the steam turbine 125 is large, the exhaust loss is not increased and the effective heat drop due to the high vacuum of the condensing chamber 127I can be utilized.

Thus, with the multi-flow exhaust-type condensing turbine installation according to the invention, the plant thermal consumption factor is greatly improved when compared with that of a conventional installation. As is clear from the following Table 2 in which the data of a large capacity steam turbine installation having, for instance, a four-flow type low pressure turbine and an output of 350 MW to which the technical concept of the invention is applied to compared with that of a condensing turbine installation employing the conventional double pressure type condenser, the thermal consumption factor can be improved by 11 Kcal/KWh when compared with that of a single pressure-type condenser and by 9 Kcal/KWh when compared with that of the conventional double pressure-type condenser.

TABLE 2

| | Single pressure type condenser | Conventional double pressure type condenser | | Double pressure type condenser of the invention | |
|---|---|---|---|---|---|
| Output (MW) | 350 | 350 | | 350 | |
| Initial steam pressure (atg) | 250 | 250 | | 250 | |
| Initial steam temperature (°C.) | 538 | 538 | | 538 | |
| Reheat temperature (°C.) | 538 | 538 | | 538 | |
| Cooling water temperature (°C.) | 21.7 | 21.7 | | 21.7 | |
| Cooling water quantity (t/h) | 34800 | 34800 | | 34800 | |
| Cooling area ($m^2$) | 19142 | 9571 | 9571 | 12826 | 12304 |
| Final temperature difference (°C.) | 2.8 | 4.3 | 4.0 | 2.8 | 2.8 |
| Condenser pressure (ata) | 0.052 | 0.044 | 0.056 | 0.0406 | 0.052 |
| Final stage steam path area ($m^2$) | 10 10 | 10 | 10 | 12.6 | 10 |
| Thermal consumption factor (Kcal/KWh) | 1845 | 1843 | | 1834 | |

For a turbine installation according to the invention, the initial cost of the installation may in some cases be higher than that of a conventional installation because of the increased number of condensers, the increase of cooling area, and the asymmetrical construction of the turbine sections. However, any increased cost of the installation will be more than made up for by reduction of the costs of operation.

In addition, the condensing turbine installation can be made compact by forming the condensers as an integral unit as a so-called double pressure-type condenser.

While the invention has been described in detail with reference to specific embodiments thereof, it will be apparent to those skilled in the art that various changes and modifications can be made thereto without departing from the spirit and scope of the invention.

What is claimed is:

1. A double flow-type condensing turbine installation comprising:

a double flow-type steam turbine having first and second turbine sections, said first turbine section having a larger final stage steam path area than said second turbine section;

a high vacuum condenser having a cooling water system, said first turbine section being coupled to said high vacuum condensor;

a low vacuum condenser having a cooling water system, said second turbine section being coupled to said low vacuum condensor; and said cooling water systems of said high and low vacuum condensers being coupled in series with one another.

2. An installation as claimed in claim 1 in which said high vacuum condenser and said low vacuum condenser are formed as an integral unit as a double pressure-type condenser.

3. An installation as claimed in either claim 1 or 2 in which the cooling areas of said high vacuum condenser and said low vacuum condenser have values which provide substantially minimum attainable final temperature differences.

4. A multi flow-type condensing turbine installation comprising:

at least first and second double flow-type steam turbines, said first turbine having a larger final stage steam path area than said second turbine, a high vacuum condenser having a cooling water system, said first turbine being coupled to said high vacuum condenser;

a low vacuum condenser having a cooling water system, said second turbine being coupled to said low vacuum condenser; and said cooling water systems of said high and low vacuum condensers being coupled in series with one another.

5. An installation as claimed in claim 4, in which said high vacuum condenser and said low vacuum condenser are formed as an integral unit as a double pressure-type condenser.

6. An installation as claimed in either claim 4 or 5 in which the cooling areas of said high vacuum condenser and said low vacuum condenser have values which provide substantially minimum attainable final temperature differences.

* * * * *